US007396120B2

(12) United States Patent
Nakazawa et al.

(10) Patent No.: US 7,396,120 B2
(45) **Date of Patent: *Jul. 8, 2008**

(54) INKJET RECORDING METHOD AND RECORDING PRODUCT

(75) Inventors: Koichiro Nakazawa, Machida (JP); Katsuhiro Shirota, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

This patent is subject to a terminal disclaimer.

(21) Appl. No.: 10/531,228

(22) PCT Filed: Oct. 24, 2003

(86) PCT No.: PCT/JP03/13603

§ 371 (c)(1),
(2), (4) Date: Apr. 13, 2005

(87) PCT Pub. No.: WO2004/037546

PCT Pub. Date: May 6, 2004

(65) Prior Publication Data

US 2006/0012627 A1 Jan. 19, 2006

(30) Foreign Application Priority Data

Oct. 25, 2002 (JP) ..... 2002-311468

(51) Int. Cl.
*G01D 11/00* (2006.01)

(52) U.S. Cl. ..... 347/100; 347/95; 106/31.6

(58) Field of Classification Search ..... 347/100, 347/95, 96, 101; 106/31.6, 31.13, 31.27; 523/160; 428/195, 32.1
See application file for complete search history.

(56) References Cited

U.S. PATENT DOCUMENTS

| | | | | |
|---|---|---|---|---|
| 4,313,124 | A | 1/1982 | Hara | 346/140 R |
| 4,345,262 | A | 8/1982 | Shirato et al. | 346/140 R |
| 4,459,600 | A | 7/1984 | Sato et al. | 346/140 R |
| 4,463,359 | A | 7/1984 | Ayata et al. | 346/1.1 |
| 4,558,333 | A | 12/1985 | Sugitani et al. | 346/140 R |

(Continued)

FOREIGN PATENT DOCUMENTS

| | | |
|---|---|---|
| EP | 0 534 634 | 3/1993 |

(Continued)

*Primary Examiner*—Manish S. Shah
(74) *Attorney, Agent, or Firm*—Fitzpatrick, Cella, Harper & Scinto

(57) ABSTRACT

A recording method performs recording on a recording medium using a pigment ink and a reaction liquid that has a higher surface tension than that of the pigment ink and contains a polyvalent metal salt capable of agglomerating the pigment ink. The method includes the steps of applying the reaction liquid on the recording medium, and bringing the pigment ink into contact with a surface of the reaction liquid that is present on the recording medium so that a filmy agglomerate, composed of an agglomeration of pigment aggregates produced by contact between the reaction liquid and the pigment ink, is formed on the surface of the reaction liquid applied on the recording medium. The pigment aggregates migrate on the surface of the reaction liquid toward a boundary between the reaction liquid and the recording medium, and by the migration of the pigment aggregates, an agglomeration of the pigment aggregates is formed along the surface of the reaction liquid, and thereby the filmy agglomerate is formed on the surface of the reaction liquid.

4 Claims, 6 Drawing Sheets

U.S. PATENT DOCUMENTS

| | | | | |
|---|---|---|---|---|
| 4,723,129 | A | 2/1988 | Endo et al. | 346/1.1 |
| 4,740,796 | A | 4/1988 | Endo et al. | 346/1.1 |
| 5,635,325 | A | 6/1997 | Inaba et al. | 430/106 |
| 6,086,197 | A | 7/2000 | Kubota et al. | 347/96 |
| 6,238,045 | B1 | 5/2001 | Ono et al. | 347/96 |
| 6,494,569 | B2 * | 12/2002 | Koitabashi et al. | 347/100 |
| 2002/0041310 | A1 * | 4/2002 | Kaneko et al. | 347/65 |

FOREIGN PATENT DOCUMENTS

| | | |
|---|---|---|
| EP | 0 885 744 | 12/1998 |
| JP | 55-65269 | 5/1980 |
| JP | 56-89595 | 7/1981 |
| JP | 59-123670 | 7/1984 |
| JP | 59-138461 | 8/1984 |
| JP | 61-59911 | 3/1986 |
| JP | 61-59912 | 3/1986 |
| JP | 61-59914 | 3/1986 |
| JP | 63-29971 | 2/1988 |
| JP | 1-009279 | 1/1989 |
| JP | 64-9279 | 1/1989 |
| JP | 1-063185 | 3/1989 |
| JP | 64-63185 | 3/1989 |
| JP | 5-202328 | 8/1993 |
| JP | 10-195404 | 7/1998 |
| JP | 10/291305 | 11/1998 |
| JP | 2005-074655 | 3/2005 |
| JP | 2005-074656 | 3/2005 |
| WO | WO98/30398 | 7/1998 |

* cited by examiner (a)

(b)

(c)

INKJET RECORDING METHOD AND RECORDING PRODUCT

TECHNICAL FIELD

The present invention relates to an inkjet recording method and recorded product, in particular, to an inkjet recording method which provides high-quality color images on recording media, such as plain paper, which include fibers capable of absorbing ink components and to recorded product.

BACKGROUND ART

Inkjet recording methods are such methods that recording is performed by ejecting and depositing droplets of a recording liquid (ink) onto recording media such as paper. According to a method in which an electrothermal converter, as ink-ejecting energy supplying means, is used to provide thermal energy for the ink so as to produce bubbles to eject ink droplets by means of the bubbles, a high-density multi-orifice recording head can be easily realized and high-resolution and high-quality images can be recorded at a high speed (Japanese Patent Publication Nos. S61-59911, S61-59912, S61-59914).

However, inks conventionally used in inkjet recording generally include water as a main component and a solvent with a high boiling point, such as glycol, for the purpose of preventing the inks from drying and clogging. And when recording is performed on plain paper using such inks, inks can sometimes penetrate the inside of recording paper, resulting in insufficient image density or non-uniform image density, which may be attributed to non-uniform distribution of loaded fillers or sizing agents on the surface of the recording medium (recording paper).

Particularly when intending to produce color images, since a plurality of different color inks are overlapped one by one, color inks can sometimes spread or be non-uniformly mixed (hereinafter this phenomenon is referred to as bleeding) at the boundaries between images of different colors, and thus the resultant images are not satisfactory ones.

As means for prevent ink bleeding, disclosed is use of an ink which includes a compound for improving the penetration of the ink, such as a surfactant (Japanese Patent Application Laid-Open No. S55-65269). This method certainly improves the penetration of ink into recording paper and prevents bleeding to some extent, but on the other hand, it allows the colorants in the ink to penetrate deep into the recording paper, which causes such problems as decrease in image density or sharpness or strike-through of images on the back side of the recording medium. Furthermore, since it improves the ink wettability on the surface of the recording paper, ink is more likely to spread, which unfavorably causes decrease in resolution or occurrence of feathering.

There are also disclosed methods in which a liquid that contributes to production of better images is deposited on recording paper prior to ejection of a recording ink. For example, a method is disclosed in which a solution of a polymer such as carboxymethyl cellulose, polyvinyl alcohol or polyvinyl acetate is ejected onto recording paper before printing (Japanese Patent Application Laid-Open No. S56-89595). This method might cause a problem of poor fixing properties of ink because the solution itself is poor in dry-ing properties, though it can prevent bleeding.

To overcome the above described problem, there are disclosed methods: in which recording is performed by applying, on recording paper a liquid containing an organic compound that has 2 or more cationic groups per molecule and then applying an ink containing an anionic dye thereon (Japanese Patent Application Laid-Open No. S63-29971); in which recording is performed by applying an acidic liquid containing, for example, succinic acid on recording paper and then applying an ink thereon (Japanese Patent Application Laid-Open No. S64-9279); and in which a liquid that makes a dye insoluble is applied on recording paper prior to recording (Japanese Patent Application Laid-Open No. S64-63185).

In any one of the above described methods, bleeding can be prevented to some extent. However, it is after a reaction liquid has penetrated into a recording medium that coloring ink is provided onto the recording medium, and therefore, when coloring ink is provided, the reaction liquid is present in the inside of the recording medium, but not on the surface thereof, and almost all the reaction occurs in the inside of the recording medium. This results in problems of insufficient color development and strike-through, which is such a phenomenon that the colorant can be recognized on the back side of the recording medium.

As described above, there is a fear that when ink is reacted with a reaction liquid on the surface of a recording medium, it will not fix on the medium satisfactorily, whereas when ink is reacted with a reaction liquid in the inside of a recording medium, it will not develop color satisfactorily.

There is also a proposal in which reaction of polyvalent metal ions and carboxyl groups is used to prevent bleeding (Japanese Patent Application Laid-Open No. H5-202328). In this case, though bleeding is effectively prevented by the reaction of a polyvalent metal ink and carboxyl groups, there still remains a fear that when coloring ink is highly penetrative to the recording media, problems will occur of decreased color development and strike-through, because the liquid containing polyvalent metal ions are first impregnated into the recording medium and then reacted with coloring ink. Thus, this proposal lacks viewpoint of color development and still has the problem to be solved toward increase in color development, though it is effective in preventing bleeding.

DISCLOSURE OF THE INVENTION

Problems to be Solved by the Invention

As described above, there have been proposed various methods in which the reaction of coloring ink and a reaction liquid is used as means for preventing bleeding. Of the proposed methods, a method in which the reaction of a polyvalent metal ink and carboxyl groups is used enables effective prevention of bleeding, but there is so far proposed no method which enables the realization of excellent color development as well as the prevention of bleeding.

In the light of these circumstances, the present invention has been made. Accordingly, one object of the present invention is to provide an inkjet recording method which not only prevents bleeding, but also drastically improves the color development of ink, while avoiding deterioration of the fixing properties of the same, and overcomes the problem of strike-through of coloring ink on a recording medium.

Another object of this invention is to obtain recorded articles which are made up of a recording medium containing more than one fiber, such as plain paper, and an image, excellent in color development, formed thereon.

Means for Solving the Problems

The above objects are achieved by the invention described bellow. Specifically, one aspect of the present invention is a recording method in which recording on a recording medium is performed by providing the recording medium with a reaction liquid containing a polyvalent metal salt and then providing thereon with a pigment ink having a surface tension lower than that of the above reaction liquid, characterized in that the method includes the steps of bringing the reaction liquid into contact with the pigment ink on the top surface of the recording medium and forming a filmy agglomerate composed of collective aggregates at the interface between the reaction liquid and the pigment ink in contact with each other.

Other aspects of the present invention are as follows.

1. A recording method in which recording on a recording medium is performed using a pigment ink and a reaction liquid that has a higher surface tension than that of the pigment ink and contains a polyvalent metal salt capable of agglomerating the pigment ink, the method comprising the steps of:

applying the reaction liquid on the recording medium; and applying the pigment ink on the recording medium so that the pigment ink is brought into contact with the reaction liquid that is present as liquid on the top surface of the recording medium.

2. A recording method in which recording on a recording medium is performed by applying on the recording medium a reaction liquid containing a polyvalent metal salt and a surfactant and then applying thereon a pigment ink containing the surfactant the content of which is higher than that in the reaction liquid, the method comprising the steps of:

bringing the pigment ink into contact with the surface of the reaction liquid that is present on the top surface of the recording medium; and forming a filmy agglomerate composed of collective aggregates at the interface between the reaction liquid and the pigment ink in contact with each other.

3. A recording method in which recording on a recording medium is performed by applying a reaction liquid on the recording medium in advance and then applying a pigment ink thereon, the method comprising the steps of:

bringing the reaction liquid into contact with the pigment ink on the top surface of the recording medium;

forming a filmy agglomerate composed of collective aggregates at the interface between the reaction liquid and the pigment ink in contact with each other; and accelerating the penetration of the reaction liquid into the recording medium.

4. A recording method in which an image is formed on a recording medium by applying on the recording medium a reaction liquid containing a polyvalent metal salt and then applying thereon a pigment ink having a lower surface tension than that of the reaction liquid, the method comprising the steps of:

bringing the reaction liquid into contact with the pigment ink on the top surface of the recording medium; and forming a firmly agglomerate composed of collective aggregates at the interface between the reaction liquid and the pigment ink in contact with each other, wherein the solvent components of the ink and the reaction liquid are allowed to penetrate to form the agglomerate film that covers a plurality of fibers constituting the recording medium in such a manner as to cross over the plurality of fibers.

5. A recorded product having an image formed on a recording medium consisting of a large number of fibers, wherein the image includes an agglomerate film that covers a plurality of fibers constituting the recording medium so as to cross over the plurality of fibers.

6. A recorded product having an agglomerate film formed on a recording medium consisting of a large number of fibers, wherein the agglomerate film covers a plurality of fibers so as to cross over the plurality of fibers.

7. A recorded product having an agglomerate film formed on a recording medium consisting of a large number of fibers, wherein the agglomerate film covers irregularities of a plurality of fibers so as to cross over the irregularities.

Advantages of the Invention

According to the present invention, a recording method is provided which improves the color development of ink while avoiding deterioration of fixing properties of the same. This method is particularly effective in recording on a recording medium containing a plurality of fibers, such as plain paper, and enables the production of a recorded product made up of a recording medium containing a plurality of fibers and an image of excellent color development.

Figure 3:
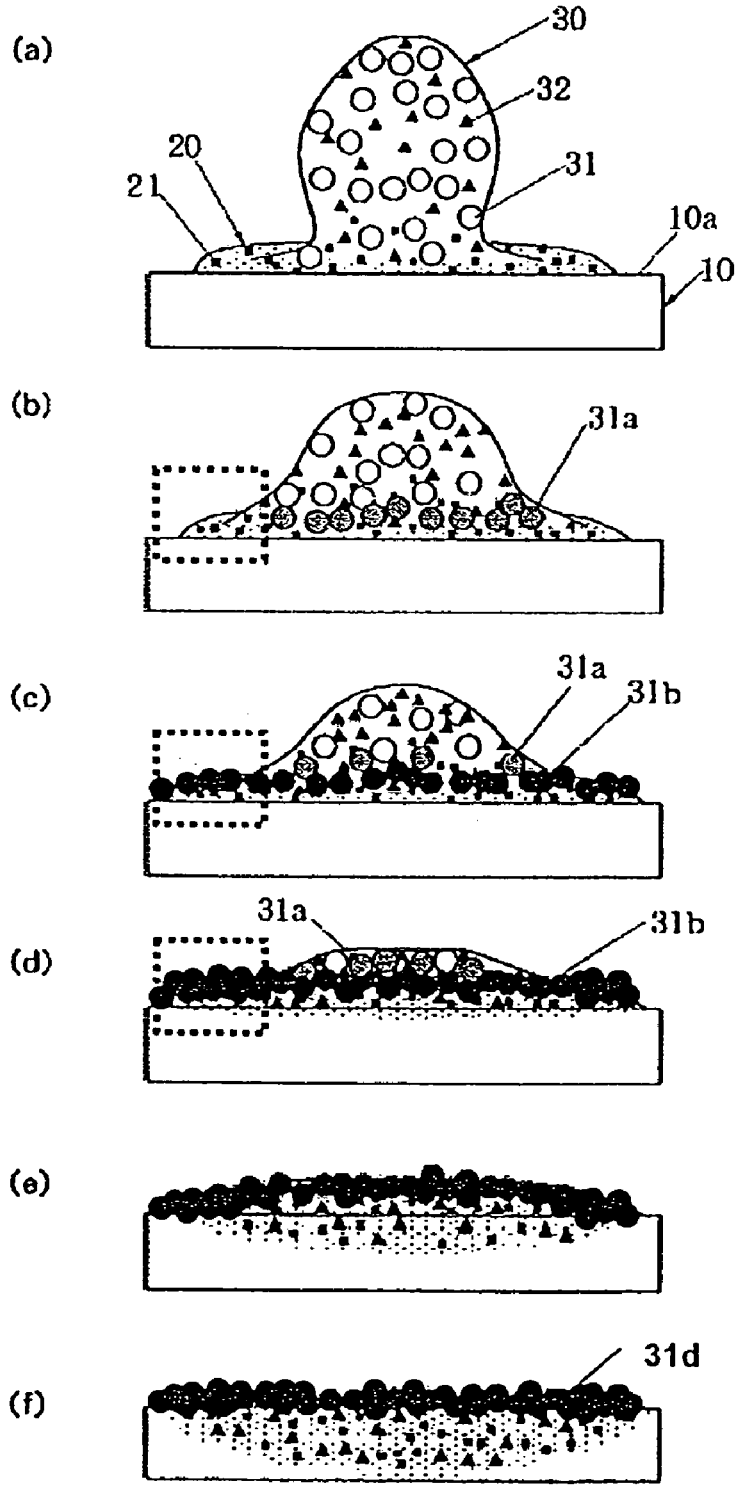
Figure 4:
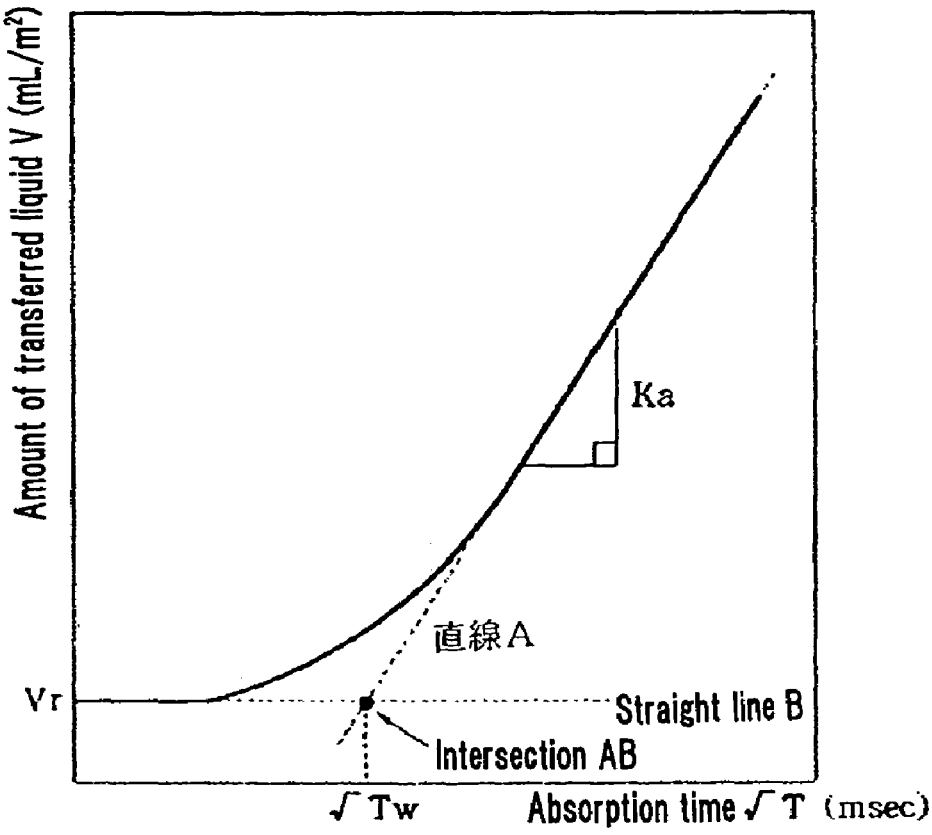
Figure 5:
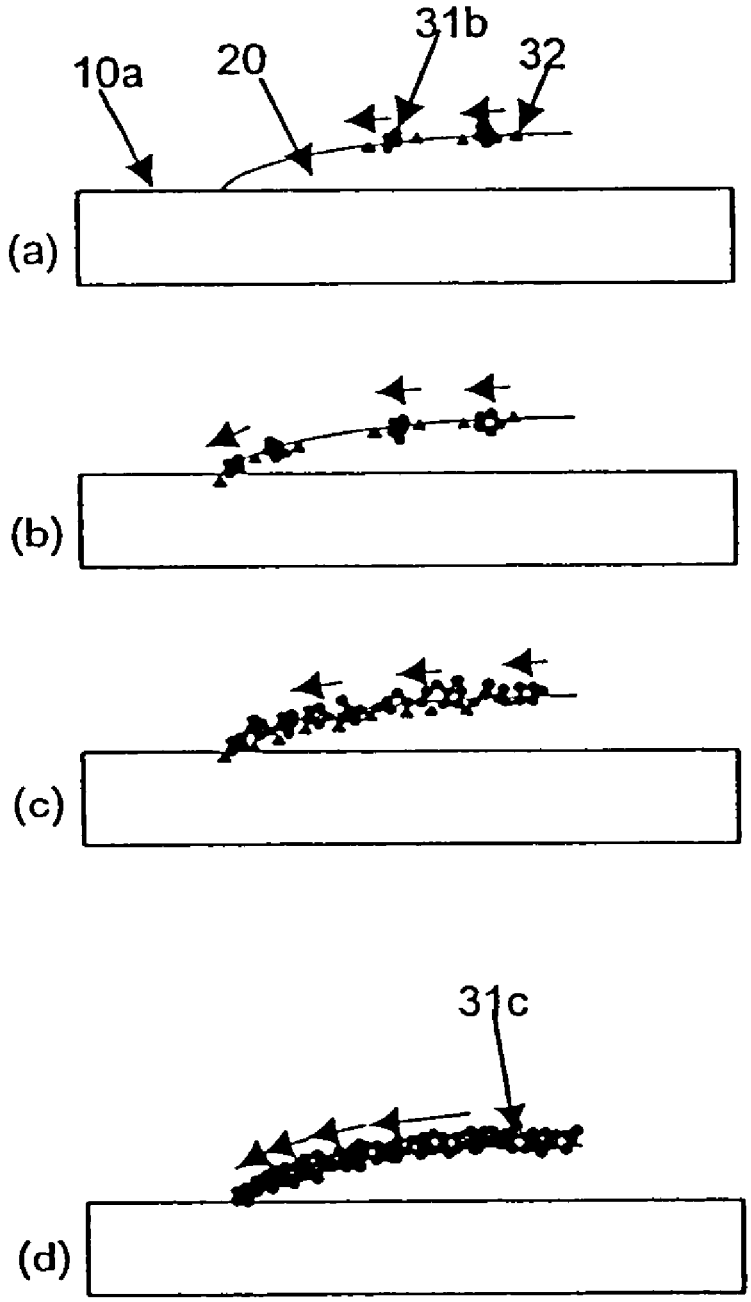

(a), (b), (c), (d), (e) and (f) of FIG. 3 are schematic sectional views showing the behavior of ink on a recording medium in accordance with the inkjet recording method of the present invention;

FIG. 4 is an absorption curve obtained by Bristow's method;

(a), (b), (c) and (d) of FIG. 5 are views showing a state in which aggregates 31*b* agglomerate to form a filmy agglomerate 31*c;*

Figure 6:
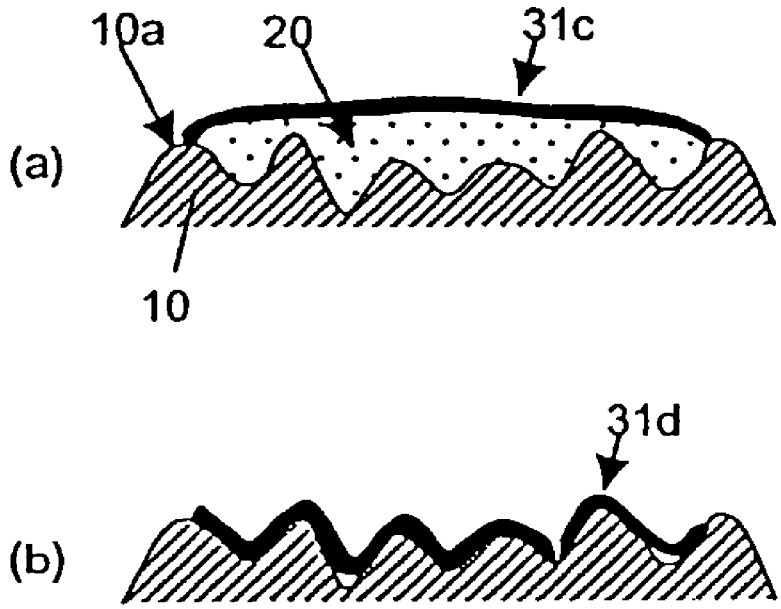

(a) and (b) of FIG. 6 are views showing a state in which the filmy agglomerate 31*c* fixes on the surface of a recording medium to form an agglomeration film 31*d;*

Figure 7:
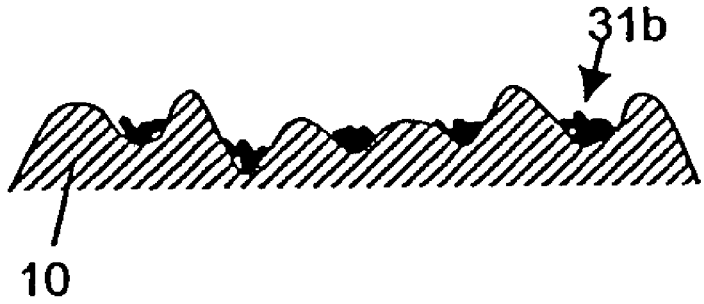
Figure 8:
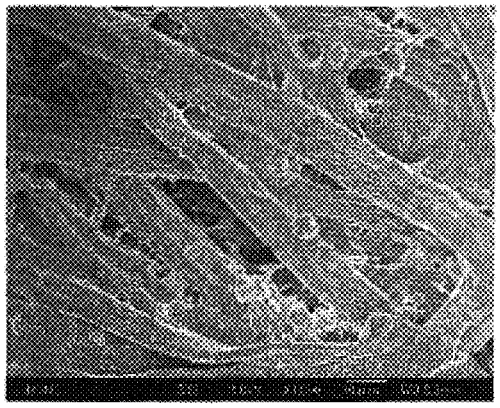
Figure 8:
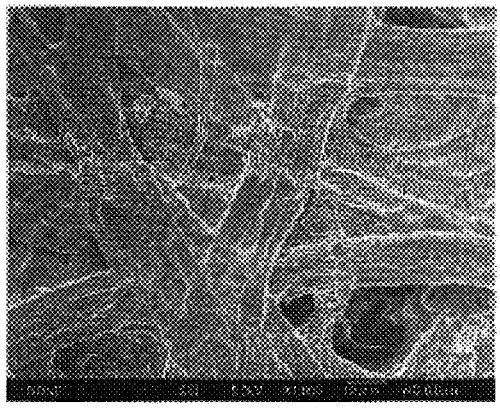
Figure 8:
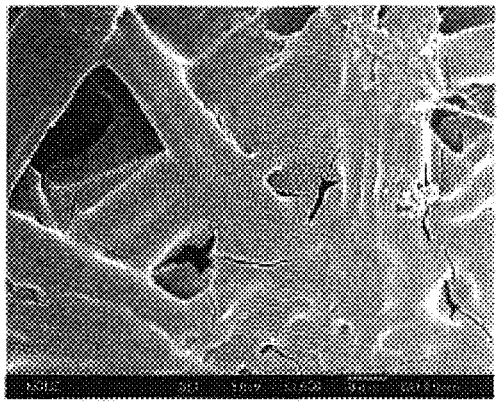

FIG. 7 is a view showing the state of the recording medium surface on which no agglomerate film 31*d* has been formed; and (a), (b) and (c) of FIG. 8 are electron micrographs of the surface of a recording medium.

DESCRIPTION OF THE PREFERRED EMBODIMENTS

In the following the present invention will be described in further detail in terms of preferred embodiments. The inkjet recording method of the present invention will be described with reference to (a) to (f) of FIG. 3 through (a) to (c) of FIG. 8.

(a) to (f) of FIG. 3 show the basic concept of the present invention. (a) of FIG. 3 shows a step of bringing a reaction liquid 20 into contact with a pigment ink 30 on the top surface of a recording medium 10, in other words, it shows the instant the pigment ink 30 is applied to the recording medium 10 with its top surface having been provided with the reaction liquid 20 in advance and comes in contact with the reaction liquid 20. In this step, from the viewpoint of bringing the reaction liquid and the pigment ink into contact with each other in a liquid state and of immediate fixing of a film-like aggregate on the recording medium, the pigment ink has a penetration higher than that of the reaction liquid. Specifically, the pigment ink has a surface tension lower than that of the reaction liquid. The relationship between the surface tension of the reaction liquid and that of the pigment ink can be adjusted by changing the ratio of the surfactant content in the reaction liquid and in the pigment ink.

The method of applying the reaction liquid 20 is not particularly specified in the present invention, but the inkjet method, which is a well-known technique, can be suitably used. To bring the pigment ink 30 into contact with the reaction liquid 20 on the top surface of the recording medium 10, it is necessary to provide the pigment ink 30 before the whole reaction liquid 20 provided on the recording medium 10 penetrates into the recording medium 10. In other words, the pigment ink is brought into contact with the reaction liquid while the reaction liquid is present on the top surface of the recording medium in a liquid state. This is one of the characteristics of the present invention. To realize this, the reaction liquid 20 used preferably has low penetrability into the recording medium 10. If the reaction liquid 20 has low penetrability into the recording medium 10, a certain length of time can be ensured before the pigment ink 30 is provided, and therefore suitable printing conditions are easily set.

Low penetrability of the reaction liquid 20 into the recording medium 10 can be obtained by controlling the amount of a surfactant etc., as a penetrant, added to the reaction liquid 20. Meanwhile, Bristow's method is used to evaluate the penetration of the reaction liquid 20 into the recording medium 10. Bristow's method is described in "Method for Testing the Liquid Absorption of Paper and Paper Board", JAPANTAPPI pulp and paper testing method No. 51, in which wetting time Tw, absorption coefficient Ka ($mL/m^2 \cdot ms^{1/2}$) and roughness index Vr ($mL/m^2$) are defined. Since a number of commercially available books describe the method, the detail description of the method is omitted here and only one example of the absorption curves is shown in FIG. 4.

The reaction liquid 20 starts to penetrate into the recording medium 10 when the wetting time Tw has elapsed. Accordingly, if the pigment ink 30 is applied before the whole reaction liquid 20 have penetrated into the recording medium 10, it can come into contact with the surface of the reaction liquid that is present on the top surface of the recording medium.

Accordingly, bringing the pigment ink 30 into contact with the reaction liquid 10 on the top surface of or above the recording medium 10 can be accomplished when the printing conditions are set so that Td and Tw are in the following relation:

$$Td<2.0\times Tw$$

and preferably $Td<1.0\times Tw$ (i.e. before the reaction liquid 20 starts to penetrate into the recording medium) where Td represents the time interval between the application of reaction liquid 20 onto the recording medium 10 and the application of the pigment ink 30 onto the same and Tw the wetting time of the reaction liquid 20.

In the present invention, as shown in FIG. 4, the wetting time Tw is obtained using the length of time to reach the intersection AB of two straight lines: an approximate line A for calculating an absorption coefficient Ka by the least square method and a straight line B expressed by V=Vr in which V is an amount of transferred liquid and Vr is a roughness index. Generally the liquid absorption properties of various types of plain paper can be controlled by controlling the surface tension of the liquid as a main factor, and in commonly used inkjet recording methods, the impact time interval Td between one ink impact on the recording medium and the subsequent ink impact on the same is several milliseconds. Accordingly, the reaction liquid preferably has a surface tension of 35 mN/m to 60 mN/m.

(b), (c) and (d) of FIG. 3 show a process in which a filmy agglomerate 31*c* is formed at the interface between the reaction liquid and the pigment ink in contact with each other. In this process in which a filmy agglomerate 31*c* is formed by agglomerating pigment aggregates 31*b* immediately after the previous process, being one of the characteristics of the present invention. The process in which the filmy agglomeration 31*c* is formed by the agglomeration of the aggregates 31*b* will be described in detail later with reference to (a), (b), (c) and (d) of FIG. 5.

To form the aggregates 31*b* which constitute the filmy agglomeration 31*c*, it is necessary to allow the reaction liquid 20 to react with a component contained in the pigment ink 30 to cause pigment aggregation. The optimal method for this is to add polyvalent metal ions to the reaction liquid to cause pigment aggregation. This method may be combined with another method, for example, one in which the pH of the reaction liquid is decreased to utilize an acid precipitation phenomenon or one in which a cationic organic substance is added to the reaction liquid to cause aggregation.

The polyvalent metal ions 21 contained in the reaction liquid collide with carboxylic acid ions, sulfonic acid ions or phosphoric acid ions in the pigment ink 30 to cause a reaction, thereby decreasing the dispersibility of the pigment, leading to the aggregation of the pigment. The higher the probability of the above collision is, the more the aggregation of the pigment is likely to occur. Accordingly, the polyvalent metal ions 21 are added to the reaction liquid preferably in a concentration higher than the total concentration of the oppositely charged ions present in the pigment ink that can react with the polyvalent metal ions.

The term "total charge concentration" herein used is defined as the number of polyvalent metal ions per unit mass of the reaction liquid or the number of ions of the opposite polarity, such as carboxylic acid ions, sulfonic acid ions or phosphoric acid ions, per unit mass of the pigment ink.

If the pigment ink is brought into contact with the reaction liquid while the reaction liquid is present on the top surface of the recording medium in a liquid state, the carboxylic acid ions, sulfonic acid ions or phosphoric acid ions in the pigment ink 30 bond to the polyvalent metal ions instantaneously, as shown in (b) of FIG. 3, due to their high collision probability. As a result, pigment particles 31*a*, which are the pigment particles 31 in the dispersed state with their electric repulsion vanished, are produced. And, as shown in (c) and (d) of FIG. 3, aggregates 31*b* of the pigment particles 31*a* are formed due to Van der Waals force among the pigment particles 31*a*, and then the aggregates 31*b* are agglomerated to form a filmy agglomerate 31*c*.

Here, the mechanism of forming the filmy agglomerate 31*c*, which is the agglomeration of the aggregates 31*b*, will be described in further detail with reference to (a) to (d) of FIG. 5. (a) to (d) of FIG. 5 are enlarged views of the portions of (b) to (d) of FIG. 3 bordered with a broken line. First, the aggregate 31*b* formed immediately after the pigment ink 30 is brought into contact with the reaction liquid 20 moves together with a surfactant 32 on the surface of the reaction liquid 20, as shown in (a) of FIG. 5. The reason why the aggregate 31*b* and the surfactant 32 move on the surface of the reaction liquid 20 is that since the ratio of content of the surfactant 32 in the pigment ink 30 is made high, the surfactant 32 in the pigment ink 30 moves in a oriented manner on the surface of the reaction liquid 20 when it is brought into contact with the reaction liquid 20, and the aggregate 31*b* moves with the flow of the surfactant. Then, the aggregate 31*b* stops at the boundary between the reaction liquid 20 and the recording medium 10 and the next aggregate 31*b* also moves toward the boundary, as shown in (b) of FIG. 5. And as shown in (c) of FIG. 5, aggregates 31*b* formed one after another are oriented toward the surface of the reaction liquid 20. Finally, the density of the aggregates 31*b* is increased, and the aggregates 31*b* agglomerate to form a filmy agglomerate 31*c* on the surface of the reaction liquid 20, as shown in (d) of FIG. 5.

Regarding (a) to (f) of FIG. 3 again, (e) and (f) of FIG. 3 will be described. (e) and (f) of FIG. 3 sequentially show the processes of accelerating the penetration of the reaction liquid 20 into the recording medium 10 and fixing the filmy agglomerate 31*c* onto the surface of the recording medium 10, with these processes being made to progress almost simultaneously.

The penetrant, such as the surfactant 32, and a solvent contained in the pigment ink 30 diffuse gradually into the reaction liquid 20, and with this diffusion, the penetration of the reaction liquid into the recording medium is increased; as a result, the solvent component in the reaction liquid 20 and that of the pigment ink 30 penetrate promptly into the recording medium 10.

The diffusion of the penetrant and change in the penetration of the reaction liquid is another characteristic of the present invention. (e) of FIG. 3 shows the state in which this process has progressed. Eventually, the filmy agglomerate 31*c* fixes onto the surface of the recording medium 10 (e.g. plain paper consisting of a plurality of fibers) in such a manner as to cover the surface to form an agglomeration film 31*d*, as shown in (f) of FIG. 3. But in practice, there are ups and downs on the surface of plain paper because of the unevenness of the fibers; therefore, after the formation of the filmy agglomerate 31*c* as shown in (a) of FIG. 6, the solvent component in the reaction liquid 20 and that of the pigment ink 30 penetrate promptly into the recording medium 10, and the filmy agglomerate 31*c* covers the surface of the recording medium 10 along the ups and downs consisting of the unevenness of the fibers and finally fixes onto the surface as an agglomeration film 31*d*, as shown in (b) of FIG. 6. The agglomeration film 31*d* can sometimes be a bridge-like film that covers the surface of the recording medium in such a manner as to cross over the concave portions, or cracks can sometimes be observed in the agglomeration film 31*d*, which is the characteristics of the agglomeration film 31*d*. (a) of FIG. 8 is an electron micrograph of the surface of plain paper on which nothing is printed. And according to the recording method of the present invention, the agglomeration film 31*d* covers the surface of plain paper, as shown in (c) of FIG. 8. It is apparent from the (c) of FIG. 8 that the agglomeration film 31*d* covers a plurality of fibers in such a manner as to cross over the fibers and cracks occur in the same agglomeration film 31*d*. This indicates that the process can satisfy both fixing properties and color development. Specifically, quick fixing can be accomplished by allowing the mixed liquid components of the reaction liquid 20 and the pigment ink 30 to penetrate promptly into the recording medium 10 and fixing the filmy agglomerate 31*c* promptly onto the surface of the recording medium. And excellent color development is accomplished by the agglomeration film 31*d* fixed on the surface of the recording medium in such a manner as to cover the same.

In the meantime, the cases will be described each of which lacks one of the characteristics of the present invention. As aforementioned, one characteristic of the present invention is that the pigment ink 30 is brought into contact with the reaction liquid 20 on the top surface of the recording medium 10. A case will be described in which a recording method does not include this, in other words, in which the ink is brought into contact with the reaction liquid somewhere other than the top surface of the recording medium 10. If the pigment ink 30 is brought into contact with the reaction liquid 20 having been impregnated into the recording medium 10, almost all the reaction occurs in the inside of the recording medium 10, and therefore the distribution of the pigment particles becomes larger in the inside of the recording medium than on the surface of the same. This means the resultant image is poor in color development. Further, aggregates 31*b* are not formed on the surface of the reaction liquid, and thus a filmy agglomerate 31*c*, as a product by the agglomeration of the aggregates 31*b*, is not formed, either. This also means the resultant image is poor in color development. Moreover, a problem is more likely to occur of strike-through, a phenomenon that the colorant is seen from the reversed side of the recording medium.

Another characteristic of the present invention is that the filmy agglomerate 31*c* is formed by the agglomeration of the aggregates 31*b*. A case will be described in which a recording method does not include this, in other words, in which the filmy agglomerate 31*c* is not formed. There are some cases in which pigment particles have their electric repulsion vanished and even if they aggregate, they do not form a filmy agglomerate and remain in the state of the aggregate 31*b*. The study by the present inventors has revealed that the size of such aggregates 31*b* is often 10 μm or less. In such a state, as the liquid components of the reaction liquid 20 and the pigment ink 30 penetrate into the recording medium 10, almost all the aggregates 31*b* flow into the space among fibers together with the liquid components, as illustrated in FIG. 7. Thus, the recorded product might be poor in color development, though it is excellent in ink fixing properties.

(b) of FIG. 8 is an electron micrograph sowing the state in which the aggregates 31*b* flow into the space among the fibers of plain paper. The electron micrograph seems about the same as that of (a) of FIG. 8, and it is apparent that the agglomeration film 31*d* is not formed, unlike in the electron micrograph of (c) of FIG. 8, and the recorded product is poor in color development.

To summarize what has been described so far, in the recording method of the present invention, (i) while a reaction liquid that contains a polyvalent metal salt is present on the surface of a recording medium in a liquid state, a pigment ink having a higher penetrability than that of the reaction liquid is brought into contact with the reaction liquid, (ii) a filmy agglomerate 31*c*, which is an agglomerate of aggregates 31*b* as shown in (d) of FIG. 5 or (a) of FIG. 6, is formed at the contact interface of the pigment ink and the reaction liquid, and (iii) finally an agglomeration film 31*c* as shown in (b) of FIG. 6 or (c) of FIG. 8 can be formed on the surface of the recording medium. If the present invention is applied to a recording medium, particularly to a recording medium made up of a large number of fibers such as plain paper, an agglomeration film can be formed which covers a plurality of fibers in such a manner as to cross over the same. This agglomeration film can provide excellent color development in the recorded product.

Meanwhile, in none of the aforementioned prior art, it was not known that a filmy agglomerate 31*c*, which is an agglomerate of aggregates 31*b*, is formed at the interface of the pigment ink and the reaction liquid. Accordingly, with such prior art, the filmy agglomerate 31*c* cannot be formed. And in the prior art, since the filmy agglomerate 31*c* is not formed, only aggregates as shown in FIG. 7 or (b) of FIG. 8 are finally formed on the surface of the recording medium, and thus excellent color development cannot be accomplished, unlike the case where an agglomeration film is formed.

Another characteristic of the present invention is that the penetrability of the reaction liquid 10 is changed by dispersing the penetrant contained into the pigment ink into the reaction liquid. If the penetrant is not dispersed into the reaction liquid 10, the penetrability of the reaction liquid is not changed and the liquid component of the pigment ink 30 is held on the filmy agglomerate 31*c*. Thus, it takes a long time to dry the printed portion, which causes a problem of low ink fixing properties. This is also true for the case where the pigment ink does not contain a penetrant. In this case, the penetration property of the reaction liquid 20 does not vary, and thus the printed portion holds the liquid component of the pigment ink 30 for a long time, which causes a problem of low ink fixing properties.

Then, the reaction liquid used in the present invention will be described. Most preferred examples of chemicals that are contained in the reaction liquid used in the present invention and reactive with the pigment ink used in this invention are polyvalent metal salts. Polyvalent metal salts are made up of polyvalent metal ions of two or more valences and anions bonding to the polyvalent metal ions. In the reaction liquid, at least part of such a polyvalent metal salt dissociates into ions.

Specific examples of polyvalent metal ions include divalent metal ions such as $Ca^{2+}$, $Cu^{2+}$, $Ni^{2+}$, $Mg^{2+}$ and $Zn^{2+}$; and trivalent metal ions such as $Fe^{3+}$ and $Al^{3+}$. Specific examples of anions include $Cl^-$, $NO_3^-$ and $SO_4^{2-}$. To allow the reaction liquid and the pigment ink to react instantaneously to form an agglomeration film, the total charge concentration of the polyvalent metal ions is preferably two times or more that of the ions of the opposite polarity in the pigment ink.

Examples of water-soluble organic solvents applicable to the reaction liquid used in this invention include amides such as dimethylformamide and dimethylacetamide; ketones such as acetone; ethers such as tetrahydrofuran and dioxane; polyalkylene glycols such as polyethylene glycol and polypropylene glycol; alkylene glycols such as ethylene glycol, propylene glycol, butylene glycol, triethylene glycol, 1,2,6-hexanetriol, thiodiglycol, hexylene glycol and diethylene glycol; lower alkyl ethers of polyhydric alcohol such as ethylene glycol methyl ether, diethylene glycol monomethyl ether and triethylene glycol monomethyl ether; monohydric alcohols such as ethanol, isopropyl alcohol, n-butyl alcohol and isobutyl alcohol; glycerol; N-methyl-2-pyrrolidone; 1,3-dimethyl-imidazolydinone; triethanolamine; sulfolane; and dimethyl sulfoxide. The content of the above water-soluble organic solvents in the reaction liquid used in this invention is not particularly limited; however, it is in the range of 5 to 60% by mass of the total mass of the reaction liquid and preferably in the range of 5 to 40% by mass.

The reaction liquid used in this invention may be mixed with additives such as viscosity modifier, pH adjuster, preservative and anti-oxidant depending on the situation; however, the selection and amount of surfactant, which functions as a penetrant, requires great care to control the penetration of the reaction liquid into the recording medium. The reaction liquid used in the present invention is preferably colorless; however, it can be light-colored as long as it does not change the color tone of each color ink when mixed therewith. Further, the above described reaction liquid used in the present invention is preferably adjusted so that the viscosity at around 25° C. is in the range of 1 to 30 cps.

Then, the pigment ink used in the present invention will be described. The content of pigments in the pigment ink used is in the range of 1 to 20% by mass and preferably 2 to 12% by mass of the total mass of the pigment ink. Specific examples of pigments used in the present invention are as follows. As a black pigment, carbon black is used. Preferably used is carbon black produced by, for example, the furnace process or the channel process, whose primary particle size is 15 to 40 mμm (nm), BET specific surface area is 50 to 300 $m^2/g$, DBP oil absorption is 40 to 150 ml/100 g, volatile matter content is 0.5 to 10%, and pH value is 2 to 9.

Commercially available types of carbon black having the above properties include, for example, No. 2300, No. 900, MCF88, No. 33, No. 40, No. 45, No. 52, MA7, MA8, No. 2200B (by Mitsubishi Kasei Corp.), RAVEN 1255 (by Columbia Chemical Corp.), REGAL 400R, REGAL 330R, REGAL 660R, MOGULL (so far by CABOT Corp.), ColorBlack FW1, ColorBlack FW18, ColorBlack S170, ColorBlack S150, Printex 35 and Printex U (by Degussa). Any one of these types of carbon black can be preferably used.

Examples of yellow pigments include C.I. Pigment Yellow 1, C.I. Pigment Yellow 2, C.I. Pigment Yellow 3, C.I. Pigment Yellow 13, C.I. Pigment Yellow 16 and C.I. Pigment Yellow 83. Examples of magenta pigments include: C.I. Pigment Red 5, C.I. Pigment Red 7, C.I. Pigment Red 12, C.I. Pigment Red 48 (Ca), C.I. Pigment Red 48 (Mn), C.I. Pigment Red 57 (Ca), C.I. Pigment Red 112 and C.I. Pigment Red 122. Examples of cyan pigments include: C.I. Pigment Blue 1, C.I. Pigment Blue 2, C.I. Pigment Blue 3, C.I. Pigment Blue 15 : 3, C.I. Pigment Blue 16, C.I. Pigment Blue 22, C.I. Vat Blue 4 and C.I. Vat Blue 6. It should be understood that these examples are not intended to limit the present invention. In addition to these examples, self-dispersion type of pigments and newly produced pigments can also be used in the present invention.

As a dispersant for the pigment, any water-soluble resins can be used. However, preferably used are water-soluble resins with a weight average molecular weight in the range of 1,000 to 30,000 and more preferably in the range of 3,000 to 15,000. Specific examples of such dispersants include block copolymers, random copolymers or graft copolymers made up of at least two or more monomers (at least one of them is a hydrophilic polymerizable monomer) selected from the group consisting of styrene, styrene derivatives, vinylnaphthalene, vinylnaphthalene derivatives, aliphatic alcohol esters of α, β-ethylenically unsaturated carboxylic acid, acrylic acid, acrylic acid derivatives, maleic acid, maleic acid derivatives, itaconic acid, itaconic acid derivatives, fumaric acid, fumaric acid derivatives, vinyl acetate, vinyl pyrrolidone, acrylamide and the derivatives thereof, or the salts thereof.

Natural resins such as rosin, shellac and starch can also be preferably used. These resins are soluble in a solution of a base in water, that is, they are alkali-soluble resins. Preferably, the amount of the water-soluble resin used as the pigment dispersant is in the range of 0.1 to 5% by mass of the total mass of the pigment ink.

Preferably, pigment inks containing the above described pigments are adjusted to be neutral or alkaline. Doing so makes it possible to improve the solubility of water-soluble resins used as the pigment dispersant and provide pigment inks having more excellent long-term shelf stability. Such pigment inks, however, can sometimes cause corrosion in various parts used in inkjet recording apparatus, and thus their pH is preferably kept in the range of 7 to 10.

Examples of pH adjustors used in such pigment inks include various types of organic amines such as diethanolamine and triethanolamine; inorganic alkali agents, for example, hydroxides of alkali metals such as sodium hydroxide, lithium hydroxide and potassium hydroxide; organic acids; and mineral acids. The above described pigments and water-soluble resins as dispersants are dispersed or dissolved in an aqueous liquid medium.

Aqueous liquid media suitably used in the pigment inks that contain pigments used in the present invention are solvent mixtures of water and water-soluble organic solvents. And as water, preferably used is not ordinary water that contains various ions, but deionized water.

Water-soluble organic solvents used as mixtures of water include, for example, alkyl alcohols with 1 to 4 carbon atoms such as methyl alcohol, ethyl alcohol, n-propyl alcohol, isopropyl alcohol, n-butyl alcohol, sec-butyl alcohol and tert-butyl alcohol; amide such as dimethylformamide and dimethylacetamide; ketones or ketoalcohols such as acetone and diacetone alcohol; ethers such as tetrahydrofuran and dioxane; polyalkylene glycols such as polyethylene glycol and polypropylene glycol; alkylene glycols whose alkylene groups have 2 to 6 carbon atoms such as ethylene glycol, propylene glycol, butylene glycol, triethylene glycol, 1,2,6-hexanetriol, thiodiglycol, hexylene glycol and diethylene glycol; glycerol; lower alkyl ethers of polyhydric alcohols such as ethylene glycol monomethyl (or monoethyl) ether, diethylene glycol methyl (or ethyl) ether, triethylene glycol monomethyl (or monoethyl) ether; N-methyl-2-pyrrolidone; 2-pyrrolidone; and 1,3-dimethyl-2-imidazolydinone. Of these water-soluble organic solvents, polyhydric alcohols such as diethylene glycol and lower alkyl ethers of polyhydric alcohols such as triethylene glycol monomethyl (or monoethyl) ether are preferable.

The amount of the above described water-soluble organic solvents used in the pigment ink is typically in the range of 3 to 50% by mass and preferably in the range of 3 to 40% by mass of the total mass of the pigment ink. The amount of water used in the pigment ink is in the range of 10 to 90% by mass and preferably in the range of 30 to 80% by mass of the total mass of the pigment ink.

The pigment ink used in this invention can contain not only the above described ingredients, but also other additives such as a surfactant, an anti-foaming agent and a preservative, depending on the situation, so as to provide the pigment ink with desired physical properties. Particularly a surfactant, which functions as a penetrant, needs to be added in such an appropriate amount that enables the liquid components of the reaction liquid and the pigment ink to promptly penetrate into the recording medium. The suitable amount of the surfactant added is, for example, 0.05 to 10% by mass and preferably 0.5 to 5% by mass.

Examples of anionic surfactants suitably used include any ones commonly used, such as those of the carboxylate type, sulfate ester type, sulfonate type and phosphate ester type.

The process for preparing pigment inks used in the present invention that contain the above described pigments include a first stage of obtaining a desired dispersion by adding a pigment to an aqueous medium that contains at least a water-soluble resin, as a dispersant, and water, agitating and mixing the mixture, subjecting the mixture to a dispersion process using dispersing means described later, and, if necessary, centrifuging the dispersed mixture; and a second stage of adding a sizing agent and properly selected additives as described above, followed by agitation.

When using the above described alkali-soluble resins as dispersants, it is necessary to add a base to dissolve the resins. Bases suitably used for this purpose include, for example, organic amines such as monoethanolamine, diethanolamine, triethanolamine, amine methyl propanol and ammonia; and inorganic bases such as potassium hydroxide and sodium hydroxide.

In the preparation of pigment inks that contain pigments, it is effective to pre-mix the aqueous medium that contains a pigment for 30 minutes before subjecting the medium to agitation and dispersion treatment. Such a pre-mixing operation is preferable because it improves the wettability on the pigment surface and accelerates the adsorption of a dispersant on the pigment surface.

As dispersers used in the above described dispersion treatment, any commonly used dispersing machines can be used. Specific examples of such dispersing machines include a ball mill, roll mill and sand mill. Of these, a high-speed type sand mill is preferably used. The high-speed type sand mill include, for example, Super Mill, Sand Grinder, Bead Mill, Agitator Mill, Grain Mill, Dyno Mill, Pearl Mill and Cobol Mill (all of these are trade names).

In inkjet recording methods, pigments having an optimum particle size distribution are used in pigment inks to satisfy the requirements for anti-clogging of the inks. Means for obtaining pigments having a desired particle size distribution include, for example, decreasing the size of dispersion media of dispersers; increasing the packing ratio of dispersion media; increasing the treatment time; decreasing the ejection speed; sorting with a filter or centrifuge after grinding; and the combination thereof.

Then, the inkjet recording method of the present invention will be described. Specific examples of cartridges for liquid compositions, recording units, inkjet recording apparatuses and liquid ejecting heads suitably used for these apparatuses, for which liquid compositions of the above described reaction liquid and pigment ink are suitably used, will be described with reference to FIG. 1 and FIG. 2.

Figure 1:
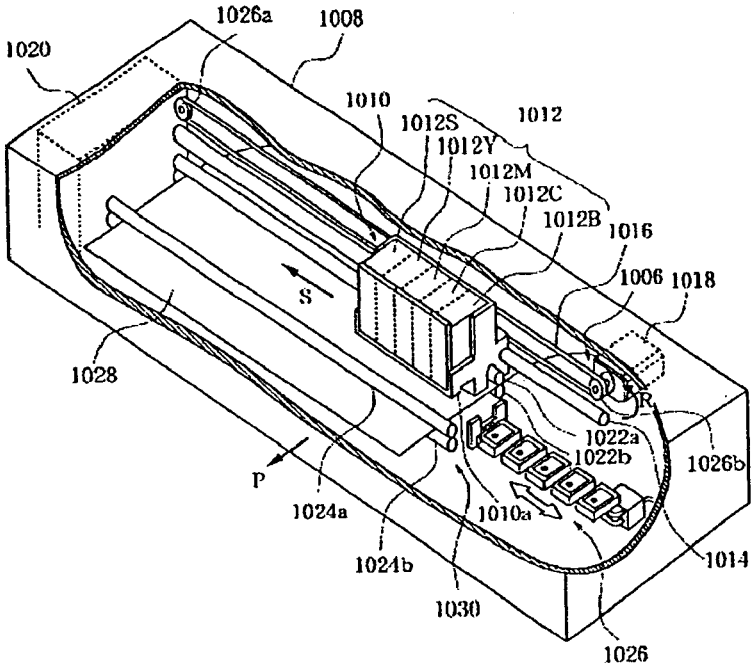
FIG. 1 is a schematic perspective view of one example of inkjet printers.

FIG. 1 is a schematic perspective view of the main part of a liquid ejecting head, as an inkjet recording head of the ejection type in which bubbles are communicated with the atmospheric air at the time of ink ejection, and of one example of inkjet printers, as a liquid ejecting apparatus using the above head, both of which are suitable for the inkjet recording apparatus used in the present invention.

In FIG. 1, the inkjet printer includes a carrying device 1030 that intermittently carries paper 1028, as a recording medium, provided in a casing 1008 across the length of the casing in the direction shown by the arrow P in the FIG.; a recording portion 1010 that is moved back and forth along a guide shaft 1014 almost parallel to the direction shown by the arrow S, which is almost perpendicular to the direction P in which the paper 1028 is carried by the carrying device 1030; and a moving driving portion 1006, as driving means, that moves the recording portion 1010 back and forth.

The moving driving portion 1006 includes pulleys 1026*a* and 1026*b* that are spaced at a prescribed interval opposite to each other on a rotating shaft; a belt 1016 wound around the pulleys; roller units 1022*a* and 1022*b*; and a motor 1018 that drives forward and backward the belt 1016, which is arranged almost parallel to the roller units and connected to a carriage member 1010*a* of the recording portion 1010.

When the motor 1018 is operated and the belt 1016 is rotated in the direction shown by the arrow R of FIG. 1, the carriage member 1010*a* of the recording portion 1010 is moved by a prescribed movement in the direction shown by the arrow S of FIG. 1. When the motor 1018 is operated and the belt 1016 is rotated in the direction opposite to that shown by the arrow R of FIG. 1, the carriage member 1010*a* of the recording portion 1010 is moved by a prescribed movement in the direction opposite to that shown by the arrow S of FIG. 1.

On one end of the moving driving portion 1006, recovering units 1026 for performing ejection recovering treatment for the recording portion 1010 are provided in the position, as the home position of the carriage member 1010*a*, in such a manner as to be opposite to the array of the ink ejection orifices of the recording portion 1010.

In the recording portion 1010, inkjet cartridges (hereinafter sometimes referred to simply as "cartridge"), 1012Y, 1012M, 1012C and 1012B for pigment inks containing yellow, magenta, cyan and black pigments, respectively and 1012S for a reaction liquid, are provided to the carriage member 1010*a* in a removable manner.

Figure 2:
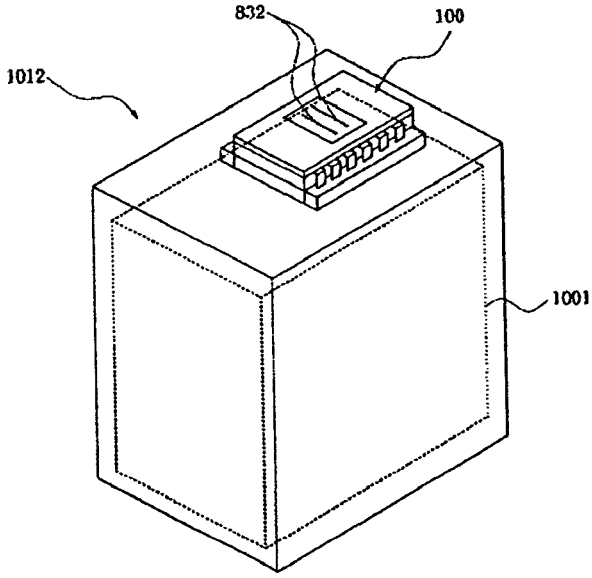
FIG. 2 is a schematic perspective view of one example of inkjet cartridges.

FIG. 2 shows one example of inkjet cartridges that can be mounted on the above described inkjet recording apparatus. A cartridge 1012 as the example is a serial type one and its main part includes an inkjet recording head 100 and a liquid tank 1001 which contains a liquid such as ink.

In the inkjet recording head 100, a number of ejecting orifices 832 are formed and a liquid such as a liquid composition is introduced from the liquid tank 1001 to a common liquid chamber (not shown in the FIG.) of the liquid ejecting head 100 via a liquid feeding passage not shown in the FIG. The cartridge 1012 shown in FIG. 2 is a cartridge in which the inkjet recording head 100 and the liquid tank 1001 are integrally formed so that a liquid can be fed into the liquid tank 1001 as need arises. However, the cartridge 1012 may have a structure in which the liquid tank 1001 is exchangeably connected to the liquid ejecting head 100.

The recording method of the present invention is highly effective when used in inkjet recording heads or recording apparatuses, particularly in those utilizing thermal energy to form liquid droplets and ejecting them to perform recording. Typical constructions and principles of such recording heads and apparatuses are disclosed in, for example, U.S. Pat. Nos. 4,723,129 and 4,740,796. Preferably, the recording method of the present invention is used in such recording heads and recording apparatuses.

The method of the present invention is applicable to both on-demand type and continuous type of recording heads and apparatuses; however, its application to the on-demand type of ones is more effective. The reason is that in the on-demand type of recording heads and apparatuses, bubble formation in a liquid (ink) and application of a driving signal can be a one-to-one correspondence. Specifically, electrothermal converters arranged for a sheet and liquid passages that hold a liquid (ink) are allowed to generate thermal energy by applying at least one driving signal that corresponds to recording information and provides a rapid temperature increase exceeding the temperature that can cause the film boiling, whereby the film boiling is caused in the heat acting surface of the recording head. The liquid (ink) is ejected through an ejecting orifice by the growth and shrinkage of the bubble and forms at least one liquid droplet. Preferably, the driving signal is in a pulse form, because the growth and shrinkage of bubbles can be promptly and properly performed, whereby liquid (ink) ejection excellent in response can be accomplished.

As driving signals in a pulse form, those disclosed in U.S. Pat. Nos. 4,463,359 and 4,345,262 are suitably used. Employing the conditions disclosed in U.S. Pat. No. 4,313,124, which discloses an invention about temperature increase rate on the heat acting surface described above, ensures much more excellent recording.

As the construction of a recording head that is a constituent of an ink cartridge, a recording unit and an inkjet recording apparatus, not only the construction disclosed in the above patent specifications in which orifices, liquid passages and electrothermal converters are combined (straight-line liquid passages or right-angled liquid passages), but also the construction disclosed in U.S. Pat. Nos. 4,558,333 and 4,459,600 in which the heat acting portion is arranged in the bending area can also be preferably used.

The construction based on the disclosure of Japanese Patent Application Laid-Open No. S59-123670, in which a slit common to a plurality of electrothermal converters is provided as an ejection portion of the converters, or that based on the disclosure of Japanese Patent Application Laid-Open No. S59-138461, in which openings for absorbing the pressure wave of thermal energy are provided corresponding to the ejection orifices, is also effectively used.

As the full-line type of recording head, whose length corresponds to the maximum width of a recording medium on which the recording apparatus can perform recording, a plurality of recording heads as disclosed in the above described patent specifications can be used in combination so as to be sufficient for the length, or a recording head may be constructed as an integrally formed unit.

An exchangeable chip-type recording head, which can be electrically connected to the apparatus body and can be provided with ink from the apparatus body only after it is mounted on the apparatus body, or a cartridge-type recording head, which is integral with an ink tank, can also be used.

Addition of recovery means or spare auxiliary means to the recording head provided for the inkjet recording apparatus used in the present invention is preferable because it further stabilizes the effects of the present invention. Examples of such means include capping means, cleaning means, pressurizing or suction means, electrothermal converters or other heating elements, or pre-heating means of the combination thereof for the recording head. Conducting a spare ejecting mode, in which ejection different form that for recording is performed, is also effective in realizing stable recording.

EXAMPLES

The present invention will be further illustrated by the following examples and comparative examples. Unless otherwise specified, "parts" or "%" herein used means parts by mass or % by mass. First, pigment inks of black (K), cyan (C), magenta (M) and yellow (Y) each containing a pigment and an anionic compound were obtained in the manner described below.

(Pigment Inks)

<Preparation of Pigment Dispersion> styrene/acrylic acid/ethyl acrylate copolymer (acid value 240, weight average molecular weight=5,000) 1.5 parts
monoethanolamine 1.0 parts
diethylene glycol 5.0 parts
deionized water 81.5 parts The above ingredients were mixed and warmed up to 70° C. in a water bath to completely dissolve the resin content. Ten parts of newly developed carbon black (MCF88, by Mitsubishi Kasei Corp.) and 1 part of isopropyl alcohol were added to the above solution, pre-mixed for 30 minutes and subjected to dispersion treatment under the following conditions.

dispersing machine: sand grinder (by Igarashi Kikai Co.)
grinding medium: zirconium beads, 1 mm in diameter
packing rate of grinding medium: 50% (volume ratio)
grinding duration: 3 hours This dispersion was centrifuged (12,000 rpm, 20 minutes), and coarse particles were removed to give a pigment dispersion.

<Preparation of Pigment Ink K1>

The ingredients having the composition ratio shown below were mixed using the above dispersion to prepare an ink containing a pigment to be a pigment ink. The surface tension of the pigment ink was 34 mN/m.

above prepared pigment dispersion 30.0 parts
glycerol 10.0 parts
ethylene glycol 5.0 parts
N-methylpyrrolidone 5.0 parts
ethyl alcohol 2.0 parts
Acetylenol EH (by Kawaken Fine Chemicals Co.) 1.0 part
deionized water 47.0 parts (Pigment Ink C1, M1, Y1)

Pigment inks C1, M1 and Y1 each containing a pigment were prepared in the same manner as in the preparation of pigment ink K1 except that 10 parts of carbon black (MCF88, by Mitsubishi Kasei Corp.) used in the preparation of pigment ink K1 was replaced by each of the pigments shown in Table 1 below. The surface tensions of the prepared pigment inks were 32 mN/m, 31 mN/m and 33 mN/m, respectively.

TABLE 1

| | |
|---|---|
| Color pigment ink C1 | Pigment blue 15 |
| Color pigment ink M1 | Pigment red 7 |
| Color pigment ink Y1 | Pigment yellow 74 |

<Preparation of Pigment Ink K2>

The ingredients having the composition ratio shown below were mixed using the above dispersion to prepare an ink containing a pigment to be a pigment ink. The surface tension of the pigment ink was 51 mN/m.

above prepared pigment dispersion 30.0 parts
glycerol 10.0 parts
ethylene glycol 5.0 parts
N-methylpyrrolidone 5.0 parts
ethyl alcohol 2.0 parts
Acetylenol EH (by Kawaken Fine Chemicals Co.) 0.1 part
deionized water 47.9 parts (Pigment Ink C2, M2, Y2)

Pigment inks C2, M2 and Y2 each containing a pigment were prepared in the same manner as in the preparation of pigment ink K2 except that 10 parts of carbon black (MCF88, by Mitsubishi Kasei Corp.) used in the preparation of pigment ink K2 was replaced by each of the pigments shown in Table 2 below. The surface tensions of the prepared pigment inks were 50 mN/m, 51 mN/m and 48 mN/m, respectively.

TABLE 2

| | |
|---|---|
| Color pigment ink C2 | Pigment blue 15 |
| Color pigment ink M2 | Pigment red 7 |
| Color pigment ink Y2 | Pigment yellow 74 |

(Reaction Liquids S1 to S6)

Then the ingredients shown below were mixed and dissolved, and the mixture was pressure-filtered through a 0.22-μm membrane filter (trade name: Fluoropore Filter, by Sumitomo Electric Industries, Ltd.) to obtain reaction liquid S1 whose pH was adjusted to 3.8. Reaction liquids S2 to S6 having the respective compositions shown in Table 3 below were also prepared in the same manner as above.

TABLE 3

(Unit: parts)

| | S1 | S2 | S3 | S4 | S5 | S6 |
|---|---|---|---|---|---|---|
| Diethylene glycol | 10 | 10 | 10 | 10 | 10 | 10 |
| Methyl alcohol | 5 | 5 | 5 | 5 | 5 | 5 |
| Magnesium nitrate | 3 | 3 | 3 | 3 | 3 | 0.5 |
| Acetylenol EH (by Kawaken Fine Chemicals Co.) | 0.1 | 0.3 | 0.5 | 1 | 2 | 0.1 |
| Deionized water | 81.9 | 81.7 | 81.5 | 81 | 80 | 84.4 |

Then, the wetting times Tw (msec) of the reaction liquids S1 to S5 were measured by Bristow's method. In the measurement, absorption coefficient Ka and the roughness index were measured using a dynamic penetration tester (Toyo Seiki Seisaku-Sho, Ltd.). The measurements of the wetting times Tw (msec) are shown in Table 4. The wetting times Tw were obtained as the length of time to reach the intersection AB of two straight lines: an approximate line A for calculating an absorption coefficient Ka by the least square method and a straight line B expressed by V=Vr in which V is an amount of transferred liquid and Vr is a roughness index, as shown in FIG. 4.

TABLE 4

Wetting Time Tw

| Reaction liquid | Wetting time (unit: msec) |
|---|---|
| S1 | 90 |
| S2 | 75 |
| S3 | 30 |
| S4 | 7 |
| S5 | 2 |

Example 1

Printed product 1A was prepared using the reaction liquid Si and the pigment inks K1, C1, M1 and Y1 by applying the reaction liquid S1 onto PB paper (by Canon Inc.), as plain paper, and then applying pigment inks K1, C1, M1 and Y1 thereon in this order with different time intervals Td of 5, 10, 15 and 20 msec, respectively (Td is the time interval between the provision of the reaction solution S1 and the provision of the pigment inks K1, C1, M1 and Y1), so that each pigment ink came into contact with the reaction liquid S1 and produced a solid print of 1 cm square.

The recording head used in this printing had a recording density of 1,200 dpi and was driven at a driving frequency of 15 kHz. In the head used, the volume of ink ejected per dot was 4 pl. The printing test was conducted under the standardized environmental conditions: 25° C., 55% RH.

The prepared printed product was good in terms of bleeding and no color-to-color bleeding was observed. When rubbing the printed portions with the edge of another sheet of paper about 5 seconds after the printing, no image deletion was observed. The optical densities of the printed portions of pigment inks K1, C1, M1 and Y1 were measured with a reflection densitometer, RD-19I (by Gretag Macbeth). The measurements were 1.2, 1.1, 1.2 and 1.1, respectively.

Comparative Example 1

Printed product 1B was prepared by applying the pigment inks K1, C1, M1 and Y1 without the reaction liquid S1 onto PB paper (by Canon Inc.), as plain paper, in the same manner as in example 1.

The printed product was evaluated in the same manner as in example 1. Although no image deletion was observed, the reflection densities of the printed portions of pigment inks K1, C1, M1 and Y1 were 0.8, 0.7, 0.7 and 0.6, respectively. It is apparent from these measurements that the printed product of example 1 was superior in color development to that of comparative example 1.

Comparative Example 2

Printed product 1C was obtained in the same manner as in example 1 except that the reaction liquid S1 was replaced by the reaction liquid S6. The printed product was evaluated in the same manner as in example 1. Although no image deletion was observed, the reflection densities of the printed portions of pigment inks K1, C1, M1 and Y1 were 0.95, 0.8, 0.9 and 0.8, respectively. The printed product 1C was better in bleeding than that of comparative example 1; however, in color development, the printed product of example 1 was apparently superior to that of comparative example 2.

The surfaces of the printed products 1A, 1B and 1C prepared in example 1 and comparative examples 1 and 2 were observed with a field emission scanning electron microscope, JSM-6700F (by JEOL), at ×5,000 magnification. The amount of the pigment particles present on the surface of each printed product corresponded to the color development of the same. To be specific the amount of the pigment particles was the largest in the printed product 1A and the pigment particles were fixed even on the top surface of the fibers. In the printed products 1B and 1C, the ratio of the pigment particles fixed on the fibers was low and there were observed many portions where the fiber surface was exposed.

Comparative Example 3

Printed product 1D was prepared in the same manner as in example 1 except that the pigment inks K1, C1, M1 and Y1 were replaced by the pigment inks K2, C2, M2 and Y2, respectively. When rubbing the printed portions with the edge of another sheet of paper in the same manner as in example 1, the deletion and deformation of the printed image occurred. Even 60 seconds after that, the deformation of the printed image occurred. This indicates that the fixing properties of the ink used in this comparative example were low.

When observing the printed products 1A and 1D under a microscope VH-7000 (by Keyence Corporation) at ×500 magnification, in the printed product 1A, the surface of the PB paper looked as if it was uniformly covered with the pigment and the printed portions were visually of uniform color, whereas in the printed product 1D, the ink dots were small and portions where the substrate was exposed were seen.

Example 2

Several printed products were prepared using the prepared pigment ink C1 and the reaction liquid S1 by applying the reaction liquid S1 onto PB paper (by Canon Inc.), as plain paper, and then applying pigment ink C1 thereon, while varying the time interval Td between the provision of the reaction liquid S1 and the provision of the pigment ink C1, so that the pigment ink C1 came into contact with the reaction liquid S1. The time intervals Td were 5, 10, 20, 50, 80, 140 and 180 msec. The recording head used in this printing had a recording density of 1,200 dpi and was driven at a driving frequency of 15 kHz. In the head used, the volume of ink ejected per dot was 4 pl. The printing test was conducted under the standardized environmental conditions: 25° C., 55% RH.

Example 3

Printed products were prepared in the same manner as in example 2 except that the reaction liquid S1 was replaced by the reaction liquid S2 and the time intervals Td were 5, 10, 20, 50, 80 and 140 msec.

Example 4

Printed products were prepared in the same manner as in example 2 except that the reaction liquid S1 was replaced by the reaction liquid S3 and the time intervals Td were 5, 10, 20 and 50 msec.

Example 5

Printed products were prepared in the same manner as in example 2 except that the reaction liquid S1 was replaced by the reaction liquid S4 and the time intervals Td were 5 and 10 msec.

Comparative Example 4

A printed product was prepared in the same manner as in example 2 except that the time interval Td was 300 msec.

Comparative Example 5

Printed products were prepared in the same manner as in example 3 except that the time intervals Td were 180 and 300 msec.

Comparative Example 6

Printed products were prepared in the same manner as in example 4 except that the time intervals Td were 80, 140, 180 and 300 msec.

Comparative Example 7

Printed products were prepared in the same manner as in example 5 except that the time intervals Td were 20, 50, 80, 140, 180 and 300 msec.

Comparative Example 8

Printed products were prepared in the same manner as in example 2 except that the reaction liquid S1 was replaced by the reaction liquid S5 and the time intervals Td were 5, 10, 20, 50, 80, 140, 180 and 300 msec.

Then, the printed products prepared in examples 2 to 5 and comparative examples 4 to 8 were evaluated by the following means and criteria.

1. Image Density

Reflection density was measured with a reflection densitometer for the solid images prepared in examples 2 to 5 and comparative examples 4 to 8. The results are shown in Table 5.

The evaluation criteria were as follows.

A: Reflection density is 1.0 or more.

B: Reflection density is 0.85 or more and less than 1.0.

C: Reflection density is less than 0.85.

TABLE 5

| Reaction liquid | Relationship between time interval Td and image density (common to all the colors) — Time interval Td (msec) 5 | 10 | 20 | 50 | 80 | 140 | 180 | 300 |
|---|---|---|---|---|---|---|---|---|
| S1 | A | A | A | A | A | B | B | C |
| S2 | A | A | A | A | B | B | C | C |
| S3 | A | A | A | B | C | C | C | C |
| S4 | A | B | C | C | C | C | C | C |
| S5 | C | C | C | C | C | C | C | C |

2. Strike-Through

Strike-through was evaluated in the same manner as the evaluation of image density. However, the portion to be measured was the back side of the printed portion of each recording medium. The results are shown in Table 6.

The evaluation criteria were as follows.

A: Reflection density is less than 0.2.

B: Reflection density is 0.2 or more and less than 0.4.

C: Reflection density is 0.4 or more and less than 0.6.

D: Reflection density is 0.6 or more.

TABLE 6

| Reaction liquid | Relationship between time interval Td and strike-through (common to all the colors) — Time interval Td (msec) 5 | 10 | 20 | 50 | 80 | 140 | 180 | 300 |
|---|---|---|---|---|---|---|---|---|
| S1 | A | A | A | A | A | B | B | C |
| S2 | A | A | A | A | B | B | D | D |
| S3 | A | A | A | B | D | D | D | D |
| S4 | A | B | D | D | D | D | D | D |
| S5 | D | D | D | D | D | D | D | D |

To summarize the results so far, it is evident that there is a correlation between image density and strike-through. Table 4, in which the physical properties of the reaction liquids S1 to S5 to the recording medium are depicted, and Tables 5 and 6, in which the evaluations of the printed products are depicted, indicate that in examples 2 to 5 where the relationship between the wetting time Tw of the reaction liquids S1 to S5 to the recording medium and the time interval Td between the provision of the pigment ink C1 and the provision of each of the reaction liquids S1 to S5 was $$Td<2.0\times Tw.$$

And preferably $$Td<1.0\times Tw,$$

images excellent in image density and strike-through could be obtained and in comparative examples 4 to 8, sufficient optical density was not obtained.

What is claimed is:

1. A recording method for performing recording on a recording medium using a pigment ink and a reaction liquid that has a higher surface tension than that of the pigment ink and contains a polyvalent metal salt capable of agglomerating the pigment ink, the method comprising the steps of:

applying the reaction liquid on the recording medium; and bringing the pigment ink into contact with a surface of the reaction liquid that is present on the recording medium so that a filmy agglomerate, composed of an agglomeration of pigment aggregates produced by contact between the reaction liquid and the pigment ink, is formed on the surface of the reaction liquid applied on the recording medium, wherein the pigment aggregates migrate on the surface of the reaction liquid toward a boundary between the reaction liquid and the recording medium, and by the migration of the pigment aggregates, an agglomeration of the pigment aggregates is formed along the surface of the reaction liquid, and thereby the filmy agglomerate is formed on the surface of the reaction liquid.

2. A recording method according to claim 1, wherein after the filmy agglomerate is formed on the surface of the reaction liquid, the solvent components of the ink and the reaction liquid penetrate to the recording medium, and thereby the filmy agglomerate that covers concave portions between a plurality of fibers constituting the recording medium.

3. The recording method according to claim 1, wherein the pigment ink contains a surfactant, and the surfactant migrates on the surface of the reaction liquid toward the boundary with the pigment aggregates.

4. The recording method according to claim 1, wherein the pigment ink contains a surfactant at a content higher than that in the reaction liquid.

* * * * *

UNITED STATES PATENT AND TRADEMARK OFFICE

CERTIFICATE OF CORRECTION

PATENT NO. : 7,396,120 B2
APPLICATION NO. : 10/531228
DATED : July 8, 2008
INVENTOR(S) : Koichiro Nakazawa et al.

It is certified that error appears in the above-identified patent and that said Letters Patent is hereby corrected as shown below:

COLUMN 1:

Line 62, “dry-ing” should read --drying--.

COLUMN 17:

Line 33, “specific” should read --specific,--.

Signed and Sealed this

Twenty-first Day of April, 2009

John Doll

JOHN DOLL
*Acting Director of the United States Patent and Trademark Office*